US005992526A

United States Patent [19]

Cunningham et al.

[11] Patent Number: 5,992,526

[45] Date of Patent: Nov. 30, 1999

[54] ROV DEPLOYED TREE CAP FOR A SUBSEA TREE AND METHOD OF INSTALLATION

[75] Inventors: Christopher E. Cunningham; Vincent H. Vetter, both of Spring; Shiva P. Singeetham, Houston; Edmund M. Mouret, Tomball; Christopher D. Bartlett, Spring, all of Tex.

[73] Assignee: FMC Corporation, Chicago, Ill.

[21] Appl. No.: 09/203,953

[22] Filed: Dec. 2, 1998

Related U.S. Application Data

[60] Provisional application No. 60/067,434, Dec. 3, 1997.

[51] Int. Cl.[6] ..... E21B 43/01

[52] U.S. Cl. ..... 166/343; 166/356; 166/368

[58] Field of Search ..... 166/339, 340, 166/341, 343, 360, 368, 366

[56] References Cited

U.S. PATENT DOCUMENTS

| | | | |
|---|---|---|---|
| 3,592,263 | 7/1971 | Nelson . | |
| 4,004,635 | 1/1977 | Marquaire et al. . | |
| 4,273,472 | 6/1981 | Piazza et al. . | |
| 4,405,016 | 9/1983 | Best . | |
| 4,730,677 | 3/1988 | Pearce et al. | 166/359 |
| 4,943,187 | 7/1990 | Hopper . | |
| 5,050,680 | 9/1991 | Diehl et al. . | |
| 5,107,931 | 4/1992 | Valka et al. . | |
| 5,129,460 | 7/1992 | Ritter, Jr. . | |
| 5,810,515 | 9/1998 | Fredriksen et al. . | |

OTHER PUBLICATIONS

Olivella Field Development, FMC Technical Proposal 95S–0063, Jan. 1996.

*Primary Examiner*—William Neuder

*Attorney, Agent, or Firm*—Gary L. Bush; Mayor, Day, Caldwell & Keeton, L.L.P.

[57] ABSTRACT

A lightweight ROV deployable tree cap (28) for deployment on a subsea production hub (10) of a subsea tree. A tree cap (28) has a lightweight body (30) with parallel planar sides and including suitable openings and slots for mounting of the various operating elements. A seal plate structure (64) includes a piston (66) connected to a seal plate (68) having a pair of downwardly projecting tubular seal members (70, 72) for fitting within the production bore (13) and annulus bore (15) of the tree hub (10) in a sealed landed position. Fluid pressure is applied to fluid line (96) to urge piston (66) and seal plate (68) downwardly into sealing landed position. For removal or retrieval of tree cap (28) from the installed position on subsea tree hub (10), fluid pressure is applied through fluid lines (108, 110) for the upward movement of seal plate (68) and tubular seal members (70, 72) from sealing relation with production bore (13) and annulus bore (15). Hydraulic fluid is supplied from the ROV through fluid coupling devices (98, 112) which are insertable within receptacles (110,114) in the tree cap body (30). The fluid couplers (98, 112) are removed from the operating receptacles after installation of the tree cap (28) and are parked in other receptacles on A tree frame until needed for further service, such as removal of the tree cap (28). A spare tree cap may be positioned on the tree frame and installed on the tree hub by the ROV.

28 Claims, 7 Drawing Sheets

Fig. 4
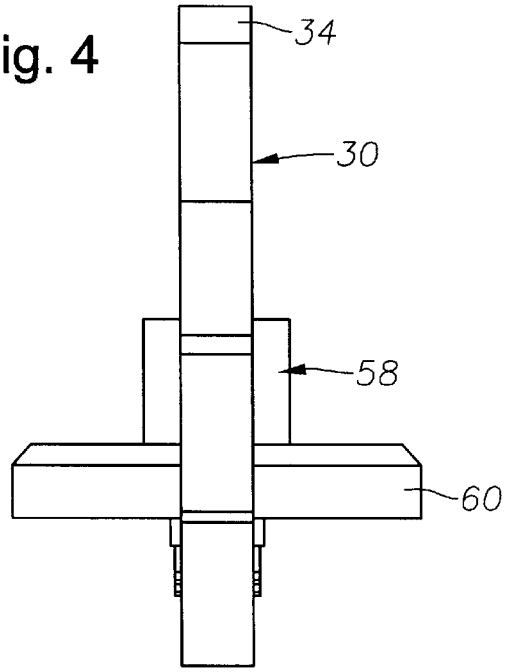
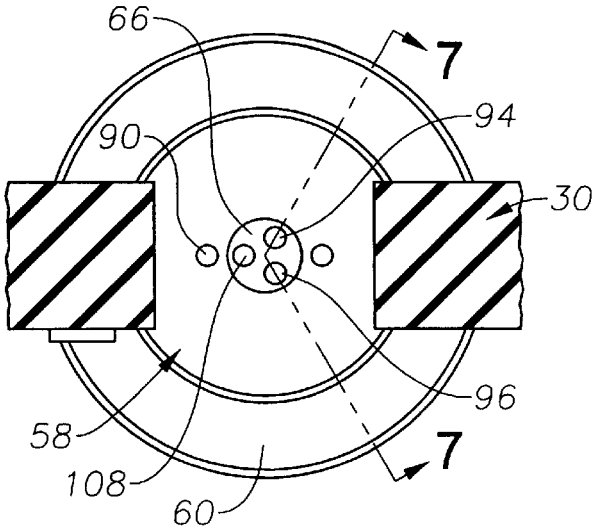
Fig. 6
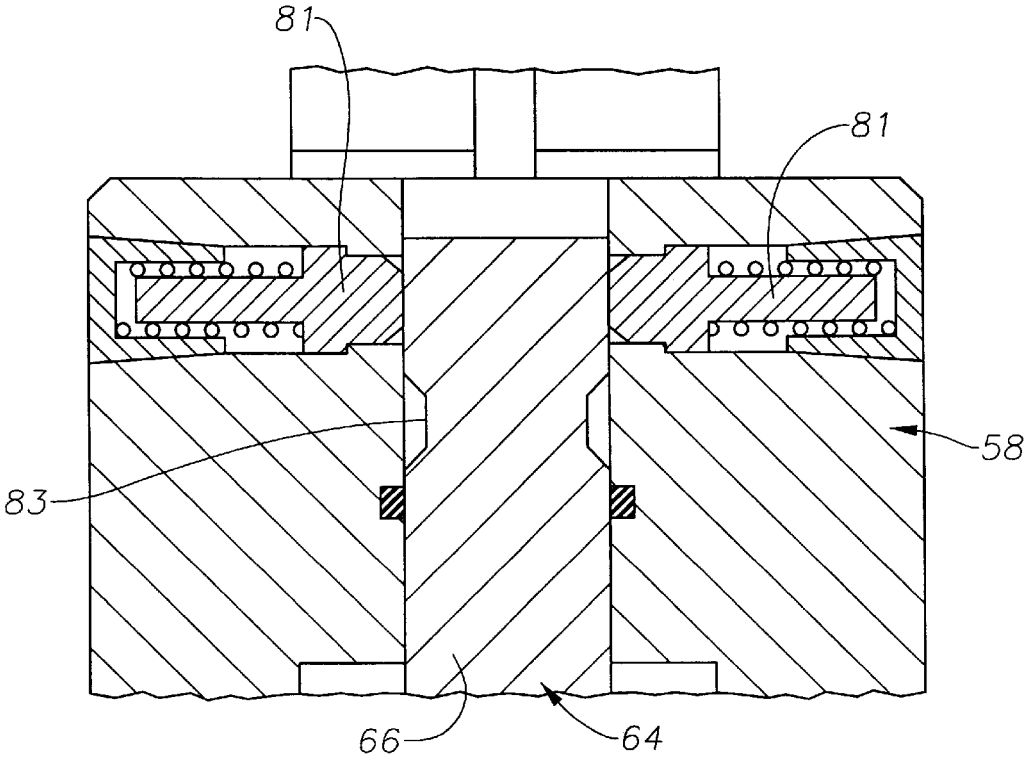
Fig. 5

ROV DEPLOYED TREE CAP FOR A SUBSEA TREE AND METHOD OF INSTALLATION

REFERENCE TO RELATED PROVISIONAL APPLICATION

This application claims the benefit of provisional application Ser. No. 60/067,434 filed Dec. 3, 1997.

BACKGROUND OF THE INVENTION

1. Field of the Invention

This invention relates generally to the field of equipment and methods of installation thereof of subsea wellhead equipment. In particular, the invention concerns a ROV deployed cap for a Xmas tree for a subsea well and the method of installing and retrieving the tree cap.

2. Background and Objects of the Invention

Prior tree caps have been installed by using a drill pipe connector arrangement. Prior tree cap design has been elaborate, almost a piece of art. Extensive machining and weight issues became the norm. An extra trip of the drill pipe was required simply to retrieve or lower the tree cap. As the offshore oil industry moves to deeper and deeper depths, the time that it takes to lower or retrieve the tree cap with drill pipe will cost a well operator thousands of dollars in rig time alone.

Accordingly, a primary object of the invention is to provide a light weight ROV installable tree cap for a subsea Xmas tree.

Another object is to provide a method of installing and retrieving the tree cap by using pressure fluid apparatus for stabbing the cap in place on the production hub and for retrieving the cap.

SUMMARY OF THE INVENTION

It is important that the tree cap when installed by a ROV (Remotely Operated Vehicle) onto a subsea Xmas tree, have the capability to stab the production and annulus seal stabs into the pockets of the tree re-entry hub. According to a preferred embodiment of the invention, two spring loaded pins latch onto the O.D. (outer diameter) hub profile of the re-entry hub initially locking the tree cap to the hub. Pressure is applied on top of the seal plate, and the seal stabs into place. During this operation, the reaction force is taken by the spring loaded latch pins. Next, pressure is applied on top of the piston which extends the locking segments out into the I.D. (inner diameter) groove of the re-entry hub, thereby locking the tree cap to the re-entry hub. Force generated by pressure below the seal stabs is transferred to the hub via the seal plate and the locking segments. Thus, the locking sequence is a two step process. The normal retrieval operation for removal of the cap from the Xmas tree includes applying fluid pressure for releasing the locking segments and for lifting the seal plate from sealing relation. Then, the latch pins are retracted and the cap is lifted by the ROV gripping a release handle.

The tree cap is arranged and designed to receive a fluid coupler installed by the ROV to provide pressure fluid to the cap for forcing the seal plate into firm stabbing position with the Xmas tree production hub and to provide high pressure fluid to a piston for forcing the locking segments into a releasably locked position with the production hub. During the retrieval operation, pressure fluid is normally provided to the piston to move the piston out of the locking position of the locking segments. Then, pressure fluid is applied beneath the seal plate to move the seal plate out of sealing relation with the production hub. Next, the spring loaded latch pins are retracted from engagement with the production hub to permit removal of the cap by lifting of the release handle on the cap.

The tree cap is designed to have a weight under about 100 pounds when submerged so that it may be easily handled by a ROV. The tree cap utilizes various plastic components which have densities approximately the same as seawater. The body of the tree cap is formed of a lightweight non-metallic plastic material to define a pair of generally parallel sides connected by upper and lower ends. The lower end has a suitable opening for mounting of a metallic sealing member therein. The upper end of the non-metallic body has a plurality of mounting positions for various control elements. Handles extend upwardly from the control elements for gripping by manipulator arms of a ROV for controlling the installation and retrieval of the tree cap.

Other objects, features, and advantages of the invention will be apparent from the following specification and drawings.

BRIEF DESCRIPTION OF THE DRAWINGS

The objects, advantages, and features of the invention will become more apparent by reference to the drawings which are appended hereto and wherein like numerals indicate like parts and wherein an illustrative embodiment of the invention is shown, of which:

FIG. 4 is an end elevational view of the tree cap shown in FIGS. 2 and 3;

FIG. 5 is an enlarged section taken generally along line 5—5 of FIG. 3;

FIG. 6 is an enlarged section taken generally along line 6—6 of FIG. 3;

DESCRIPTION OF THE INVENTION

Figure 1:
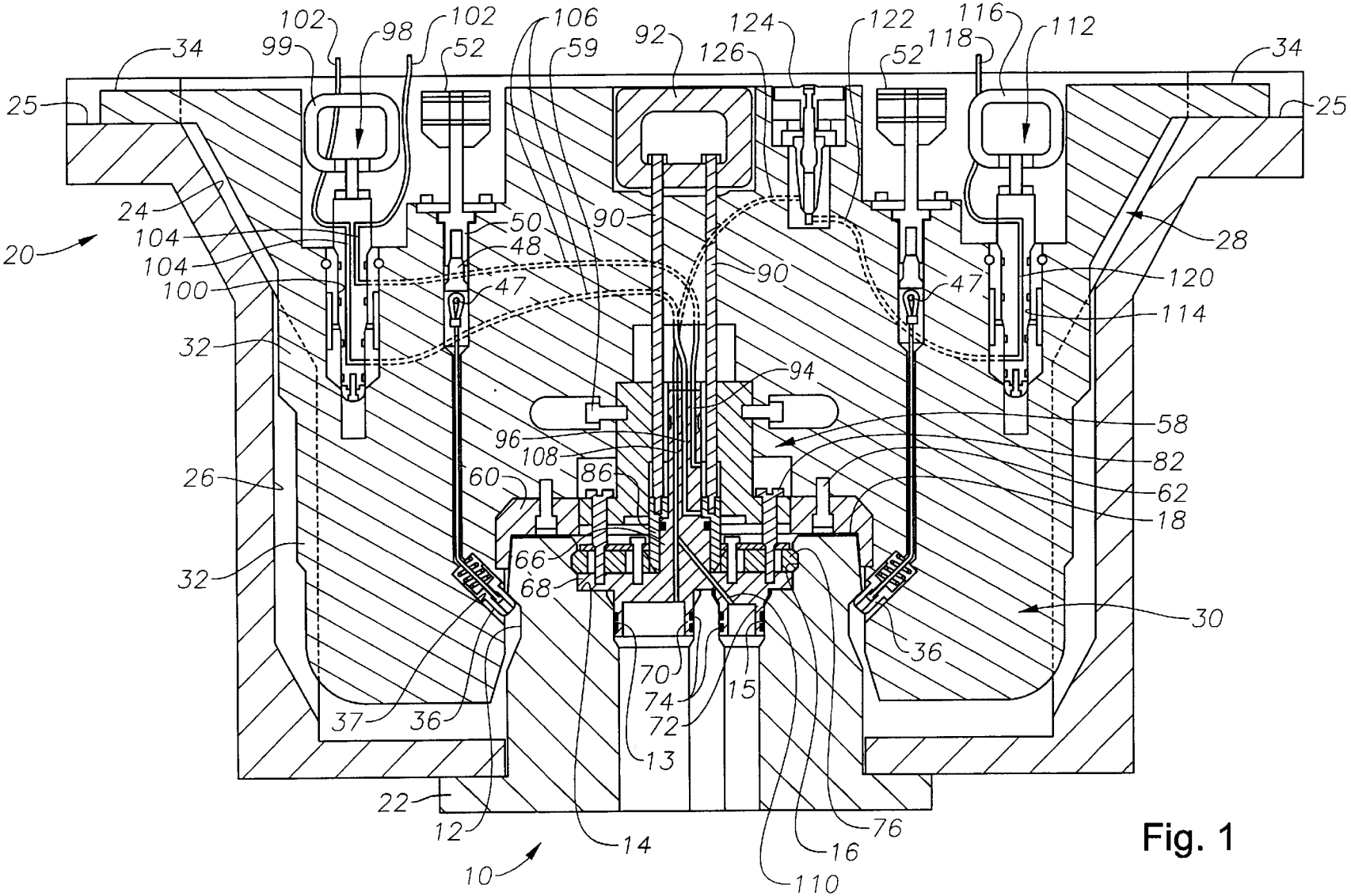
FIG. 1 is a sectional view of the ROV deployed tree cap comprising the present invention shown in an installed position on the production hub of a subsea Xmas tree.
Figure 2:
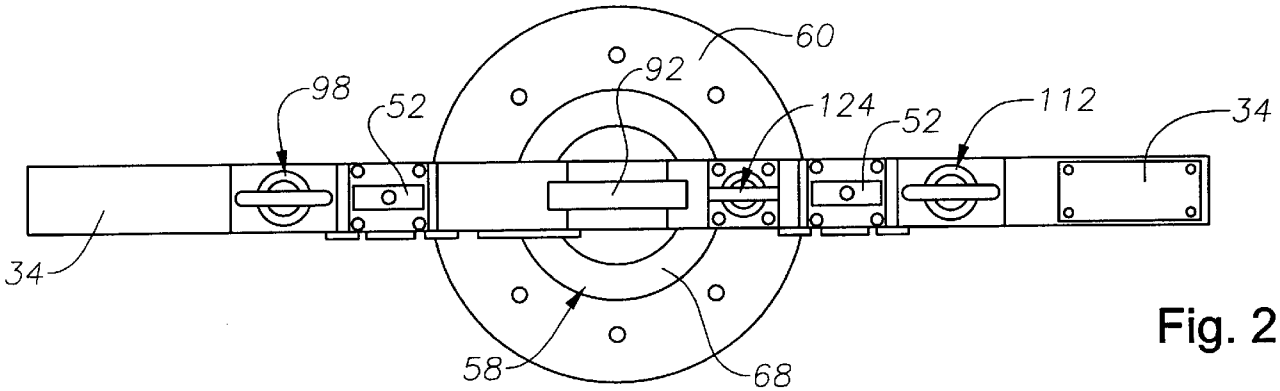
FIG. 2 is a top plan of the ROV deployed tree cap shown in FIG. 1 removed from the subsea production hub.

Referring now particularly to FIG. 1, a Xmas tree production hub is shown generally at 10 having an outer annular groove 12, an inner horizontal landing shoulder 14, an inner annular groove 16 above landing shoulder 14, and an upper planar end surface 18. Hub 10 has a production bore 13 and an annulus bore 15 therein. An outer funnel guide shown generally at 20 is supported on a flange 22 extending from hub 10 and has an inner tapered guide surface 24. Y-shaped slots 26 extend in a generally vertical direction, and a pair of opposed upper slots 25 is provided along the upper surface of funnel guide 20.

The lightweight ROV deployed tree cap is shown generally at 28 in an installed position on hub 10 of the Xmas tree. Tree cap 28, as will be explained below, has been lowered into the sea with an ROV by suitable tethers from a surface location as well known. The ROV is disengaged from the tethers at about one hundred feet above the mudline. The ROV manipulator arm then grasps a handle on tree cap 28 to disengage tree cap 28 from the tethers and then lowers the tree cap into funnel guide 20.

Figure 11:
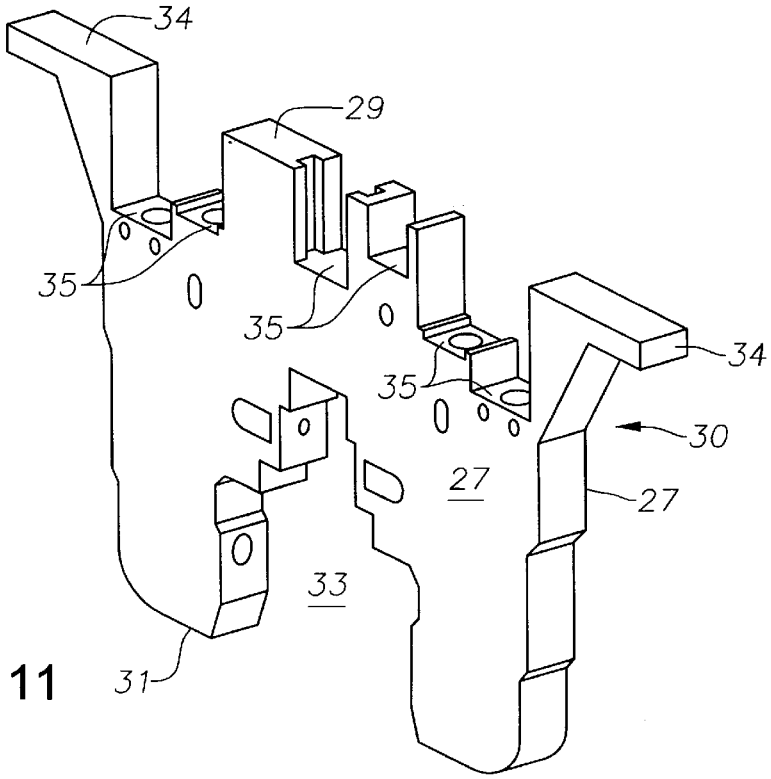
FIG. 11 is a perspective of the lightweight molded plastic body of the tree cap with all of the separate members removed therefrom.

Tree cap 28 has a body generally indicated at 30 as shown particularly in FIG. 11 formed of a non-metallic lightweight material such as polypropylene which is a thermoplastic polymer. Other plastic and composite materials may be used in forming body 30, such as fiberglass, polyethylene, or polyurethane, for example. Body 30 may be cast, molded or formed from a sheet material. The integral one piece non-metallic body 30 is shown in FIG. 11 before any of the various separate elements or members are mounted thereon. The utilization of a lightweight body permits a lightweight tree cap having a submerged weight of less than about 100 pounds, while the tree cap weighs about 225 pounds out of water. Body 30 has a pair of generally parallel opposed sides 27 connected by an upper end 29 and a lower end 31. A lower opening 33 is provided in lower end 31. Various mounting positions or bases 35 are provided in openings or slots along upper end 29. Body 30 has extensions 32 (see FIG. 1) which are received within the Y-slots 26 of funnel guide 20 for initial alignment of body 30 with hub 10. Upper arms 34 register with upper surfaces 25 of funnel guide 20 for further alignment of body 30 with hub 10. The density of the solid lightweight material of body 30 approximates the density of seawater. Since tree cap 28, including all of the members mounted thereon, has a submerged weight of less than about 100 pounds, an ROV can easily maneuver tree cap 28.

Figure 9:
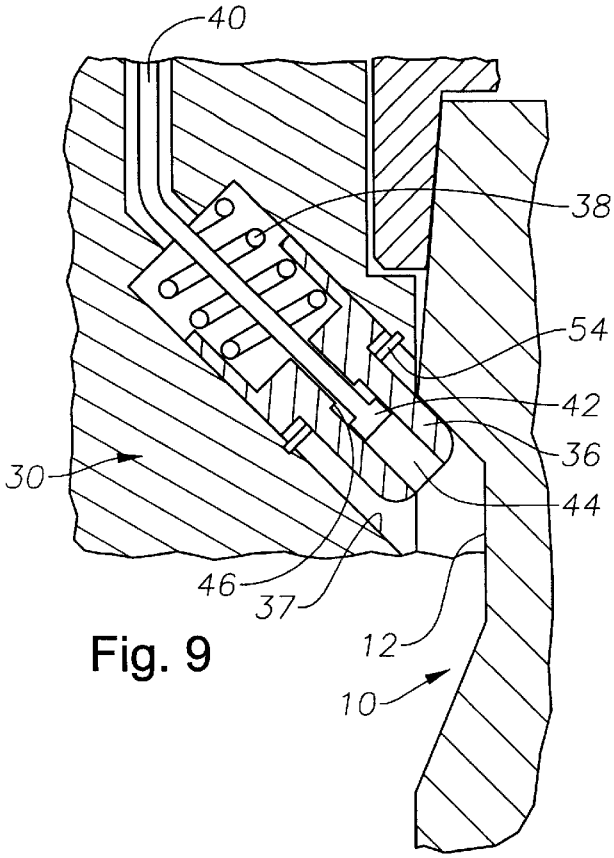
FIG. 9 is an enlarged sectional view of a latch pin for initially engaging the outer grooved profile of the production tree hub.

A pair of opposed generally identical latch pins 36 are mounted within bores 37 in body 30 as shown in FIGS. 1 and 9 with the ends of pins 36 received within outer annular groove 12 of hub 10 in latched relation. Spring 38 urges pin 36 outwardly. A flexible cable or rope 40 has an enlarged end 42 fitting within a central bore 44 of pin 36 and is adapted to contact annular shoulder 46. The upper end of flexible cable 40 is looped about an indicator pin 47 which extends through an opening in body 30 for visual observation to determine the position of pin 36. Indicator pin 47 is connected to an externally threaded rod 48 received within an internally threaded sleeve 50 connected to a handle 52. Upon rotation of handle 52, flexible cable 40 is pulled upwardly with enlarged end 42 contacting shoulder 46 to withdraw latch pin 36 from latching relation with production tree hub 10. Latch pin 36 is retained within bore 37 by retainer ring 54 and is continuously urged outwardly by spring 38.

Figure 3:
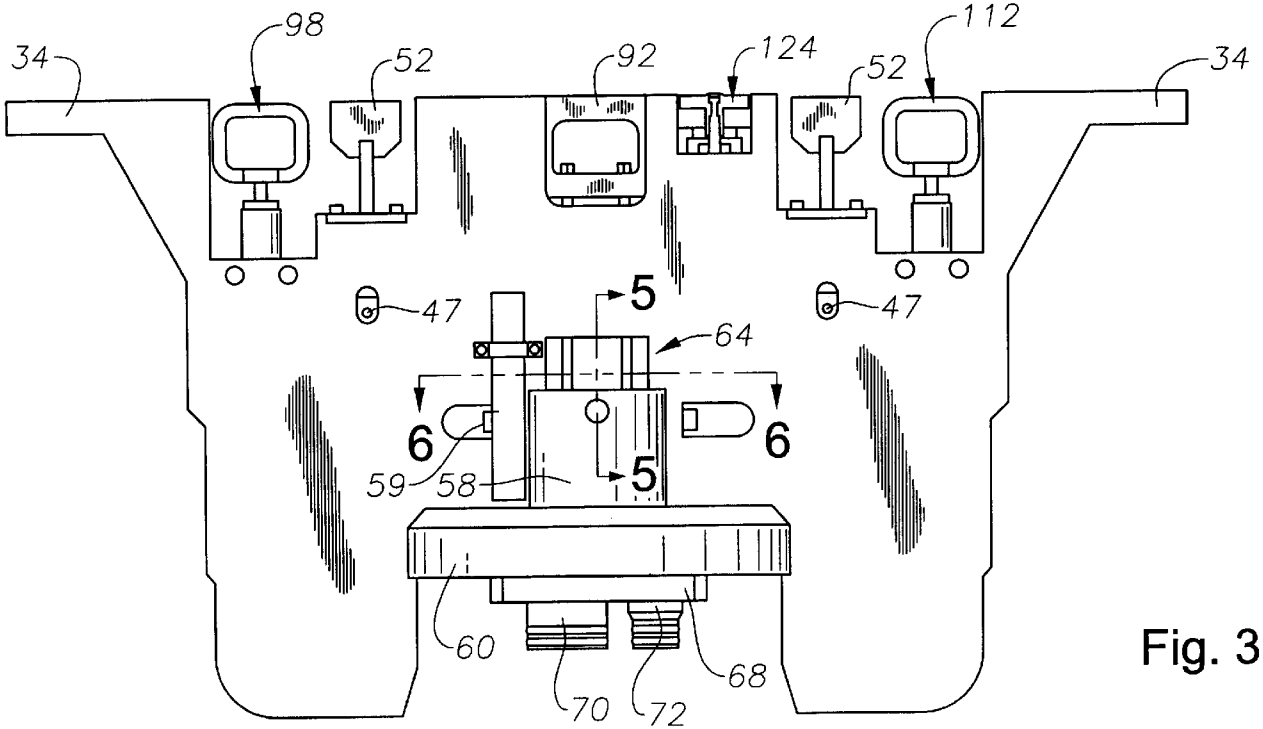
FIG. 3 is a front elevation of the tree cap shown in FIG. 2.

Mounted within lower opening 33 (see FIG. 11) in body 30 is a metallic sealing structure including an outer housing 58 fixed to body 30 by studs 59 (see FIG. 3) and having an outer ring 60 with a downwardly extending outer flange secured by studs 62 (see FIG. 1) to body 30 and adapted for fitting over the upper end 18 of hub 10. Mounted for reciprocal movement within fixed housing 58 is a seal plate assembly 64 comprising an upper cylindrical piston 66 having a lower seal plate 68 thereon including a pair of projecting tubular stab members or plugs 70, 72 for stabbing and fitting in sealing relation with production bore 13 and annulus bore 15 of tree hub 10. Suitable annular elastomeric seals 74 extend about tubular stab members 70, 72 for effective sealing against bores 13 and 15. A pair of locking segments 76 are supported on the upper surface of plate 68 by retainer bolts 78 received within enlarged openings 80 as shown particularly in FIG. 8. Position indicator rods 82 are secured to seal plate 68 to indicate the position of seal plate 68 and may be viewed in openings 84 in body 30 to determine if seal plate 68 is seated on shoulder 14 of hub 10 as shown in FIG. 1. FIG. 5 shows retaining means for releasably holding seal plate assembly 64 in an upper unsealed relation with hub 10. For releaseably retaining piston 66 and seal plate 68 in an upward position, spring urged retainer pins 81 fit within annular groove 83 until seal plate assembly 64 is forced downwardly by fluid pressure into sealing relation with hub as shown by the position in FIG. 5 and as will be explained further.

Figure 7:
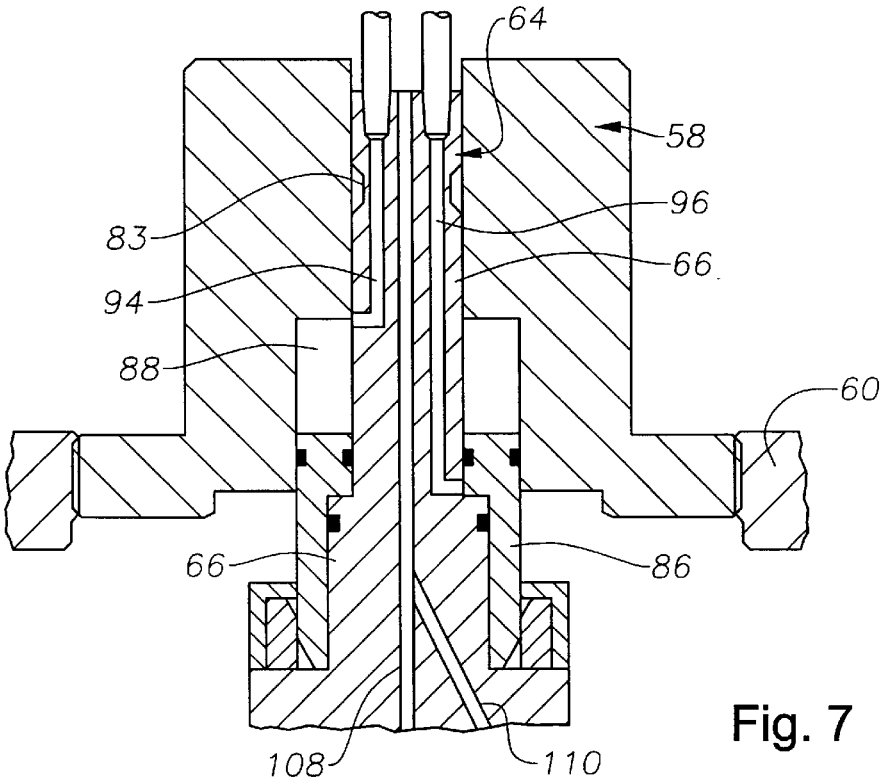
FIG. 7 is an enlarged fragment of FIG. 1 showing fluid lines for actuation of the piston for camming locking segments into a releasably locked position on the tree hub.
Figure 8:
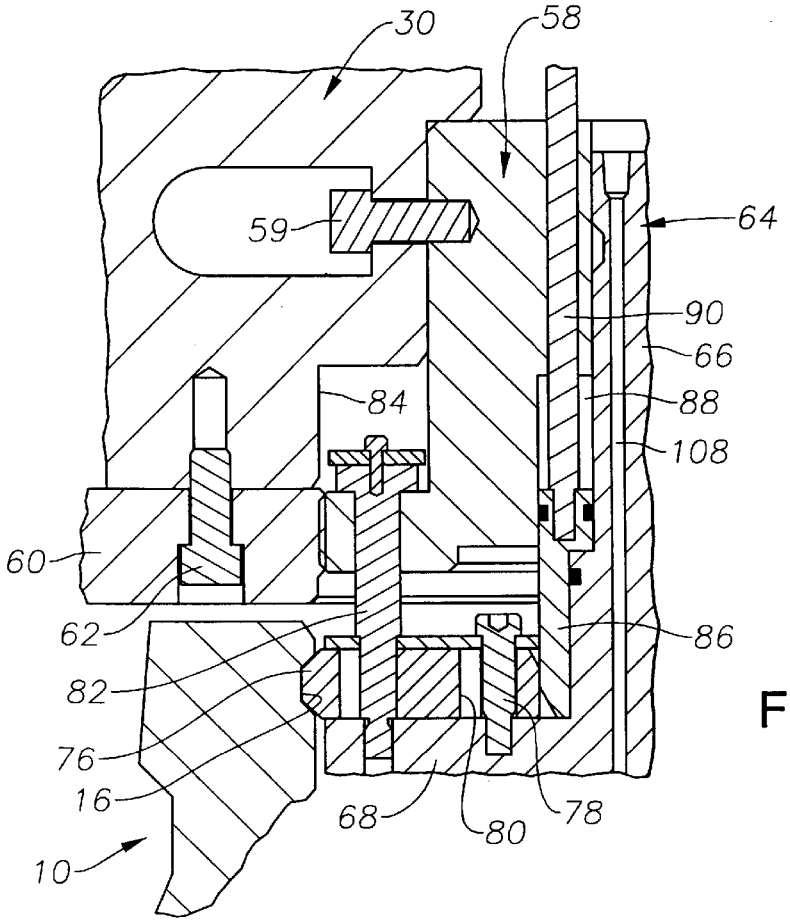
FIG. 8 is an enlarged fragmentary view of FIG. 1 showing the locking segments cammed outwardly by the piston into locking engagement with an internal groove of the production tree hub.
Figure 12:
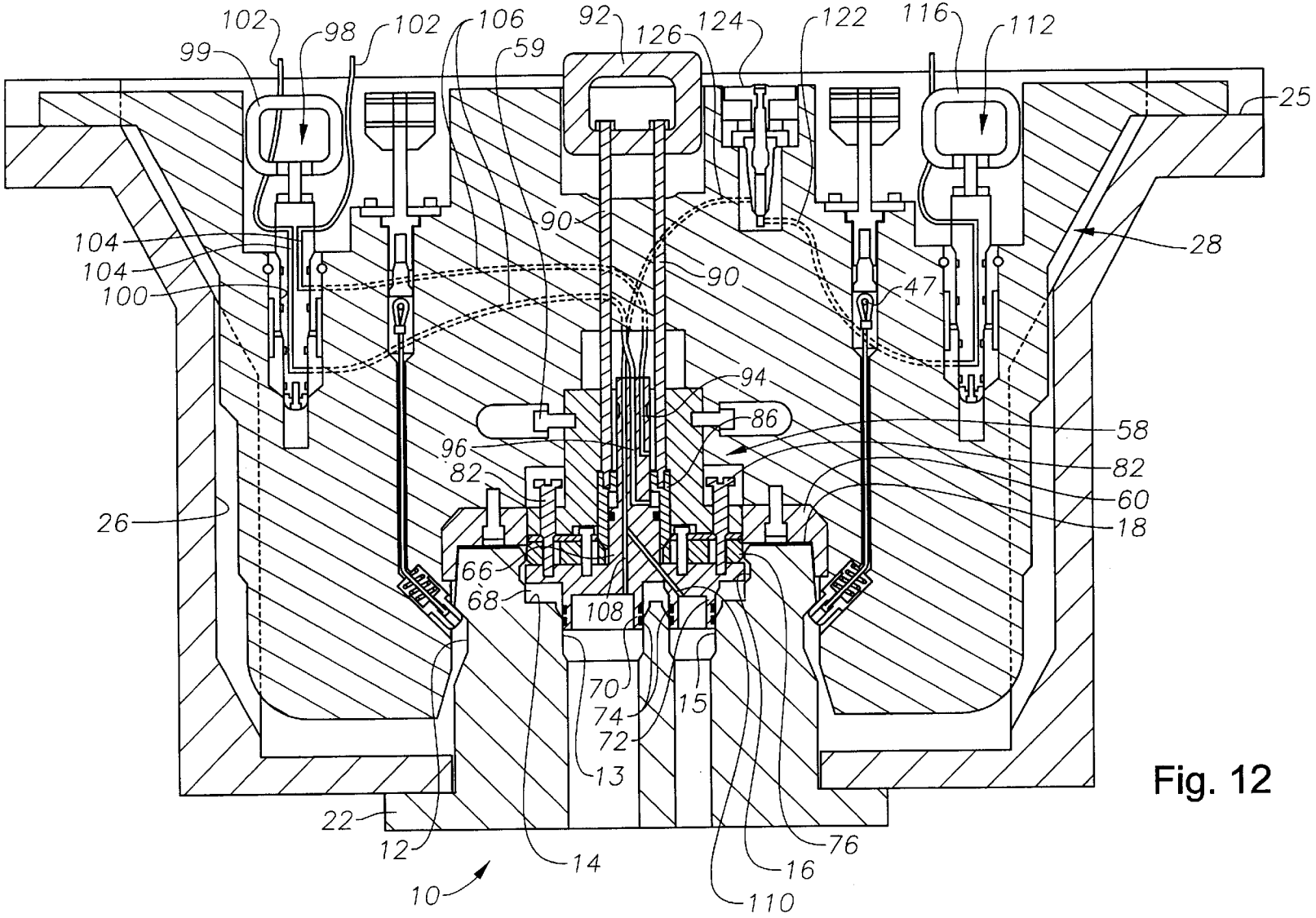
FIG. 12 is a view similar to FIG. 1 but showing the tree cap in an initial position on the production tree hub with only a pair of latch pins engaging the tree hub.
Figure 13:
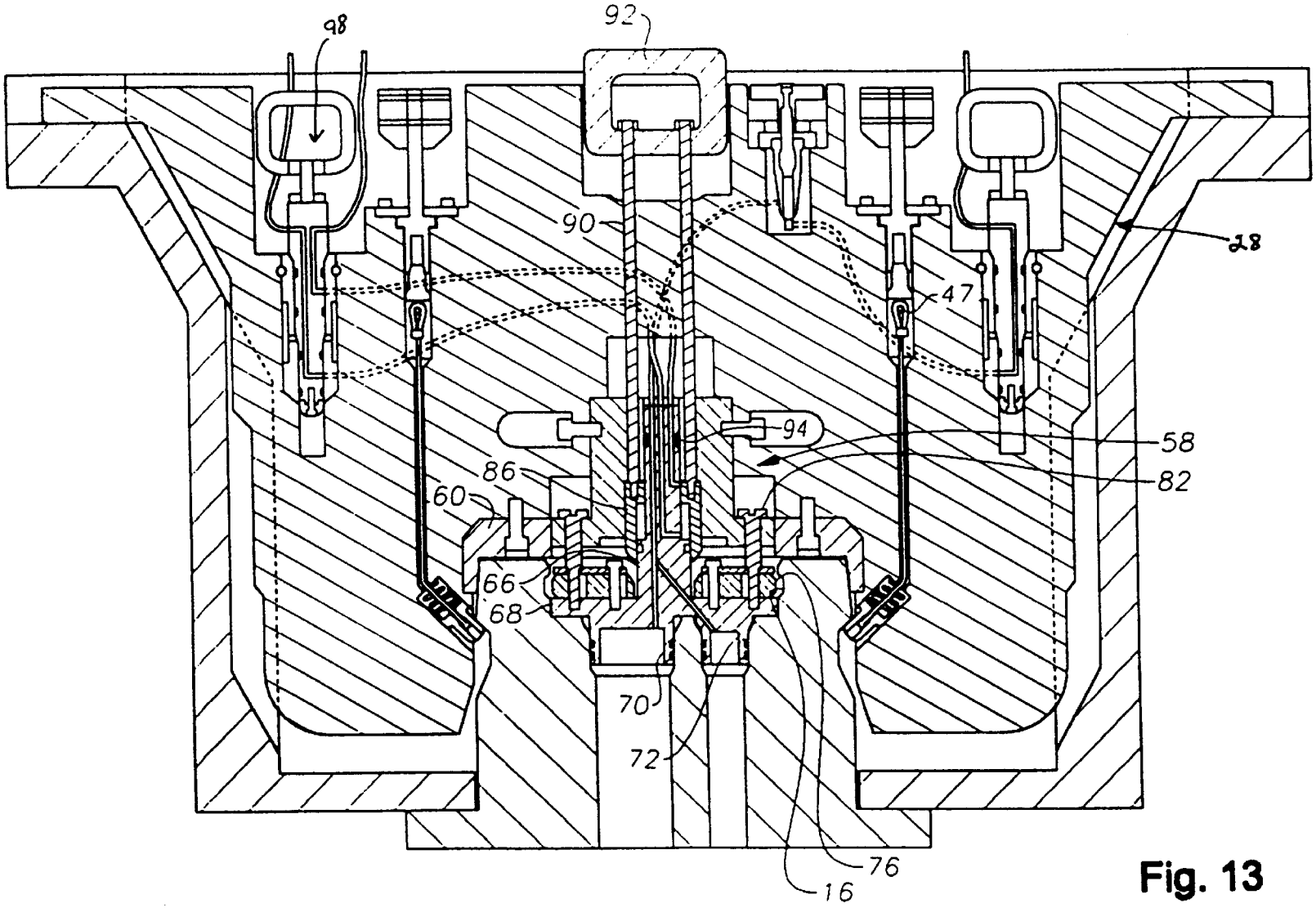
FIG. 13 is a view similar to FIG. 12 but showing the tree cap in an intermediate position with the seal plate in a landed position on the production hub and the tubular seal members projecting from the seal plate stabbed and sealed within the production bore and annulus bores of the tree hub.

To lock locking segments 76 within annular groove 16 of hub 10, an annular piston 86 extends about inner solid piston 66, and a fluid chamber 88 is provided adjacent the upper end of outer annular piston 86 as shown particularly in FIGS. 7 and 8. A pair of piston release rods 80 are secured at their lower ends to the upper end of piston 86 and secured at their upper ends to a handle 92. Handle 92 is shown in a retracted position in FIG. 1 to indicate that locking segments 76 are in locking relation with tree hub 10. When handle 92 is in a projected position as shown in FIGS. 12 and 13, piston 86 is withdrawn from engagement with locking segments 76 and locking segments 76 are removed from annular grooves 16 of tree hub 10. Handle 92 is not normally utilized to release piston 86 from engagement with locking segments 76 but may be used, such as in an emergency, for release of locking segments 76 to permit removal or retrieval of tree cap 28. Handle 92 is also utilized by manipulator arms of the ROV for lifting and maneuvering cap 28

As shown particularly in FIG. 7, an hydraulic fluid passage 94 in solid piston 66 communicates with the upper end of fluid chamber 88, and hydraulic fluid passage 96 in solid piston 66 communicates with the lower end of fluid chamber 88. To supply fluid to fluid passages 94, 96 a so-called hot stab fluid coupler 98 is releasably pushed by handle 99 within a bore in receptacle 100 in body 30 by an ROV manipulator arm. Fluid lines 102 from an ROV supply hydraulic fluid through fluid passages 104 of coupler 98 to suitable lines 106 to fluid passages 94, 96. After tree cap 28 has been installed, hot stab coupler 98 is removed by the ROV by lifting of handle 99 and a dummy stab which is carried in a receptacle on tree cap 28 is positioned within the bore of receptacle 100 to keep foreign matter and the like from receptacle 100.

Figure 10:
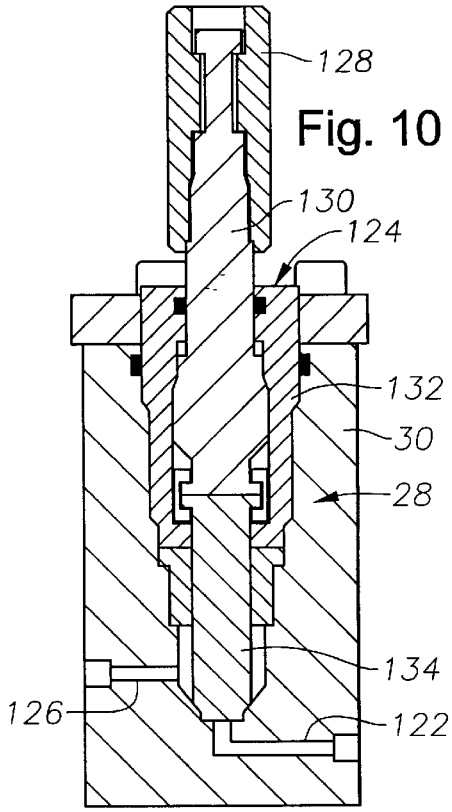
FIG. 10 is a sectional view of a needle valve assembly for controlling the hydraulic fluid flow to the seal plate for retrieval of the tree cap from the subsea tree hub.

To retrieve tree cap 28 and to remove tubular seal members 70 and 72 from sealing engagement with production bore 13 and annulus bore 15 of tree hub 10, it may be necessary to apply fluid pressure beneath seal plate 68. For that purpose, a main fluid passage 108 is provided in solid cylinder 66 to production bore 13 and a branch fluid passage 110 is provided in solid cylinder 66 to annulus bore 15. High pressure hydraulic fluid is supplied from the ROV through a hot stab coupler 112 which is received within a bore in receptacle 114 in body 30 by pushing of handle 116 by an ROV manipulator arm. Hydraulic fluid line 118 from the ROV supplies fluid through fluid passage 120 in hot stab coupler 112. Fluid from fluid passage 120 is supplied through line 122 to a needle valve assembly shown generally at 124 in FIG. 10. A fluid outlet line 126 from needle valve assembly 124 extends to main fluid passage 108 in cylinder 66. Needle valve assembly 124 shown in FIG. 10 has a handle 128 secured to shaft 130 which is threaded within outer sleeve 132. The end of shaft 130 contacts needle plug 134 to control the flow of fluid from line 122 to line 126 and fluid passage 108.

Installation of Tree Cap 28

Tree cap 28 is shown in a final installed position in FIG. 1. FIGS. 12 and 13 show initial and intermediate stages of installation with tree cap 28 being controlled by the manipulator arms of an ROV (not shown). Prior to tree cap 28 being in the position of FIG. 12, tree cap 28 has been lowered subsea with an ROV by suitable tethers from a surface location. The ROV is disengaged from the tethers at about a hundred feet above the mudline. The ROV manipulator arm then grasps tree cap 28 by handle 92 to disengage tree cap 28 from the tethers and then lowers tree cap 28 into funnel guide 20. Tree cap 28 is aligned within funnel guide 20 by Y-shaped slots 26 and a pair of opposed upper slots 25 along the upper surface of funnel guide 20. Extending arms 34 of cap 28 fit within slots 25.

After tree cap 28 is positioned within funnel guide 20 as shown in FIG. 12 with ring 60 fitting over hub 10, low pressure fluid coupler 98 along with high pressure fluid coupler 112 are installed by the ROV by inserting couplers 98 and 112 from handles 99 and 116 within the respective receptacles 100 and 114. Seal plate 68 is spaced from landing shoulder 14 on tree hub 10, and indicator rods 82 are in the raised position to indicate that seal plate 68 is not seated. Retainer pins 81 as shown in FIG. 5 are in engagement with groove 83 which releasably holds seal plate 68 in unseated relation. Also, handle 92 is in a raised position to indicate that annular piston 96 is not in locking engagement with locking segments 76. The spring loaded latch pins 36 retract as the tree cap 28 is lowered over hub 10 and then project outwardly into engagement with annular groove 12 on hub 10. Pressurized hydraulic fluid is then applied through line 96 from coupler 98 to fluid chamber 88 to urge the piston 66 and seal plate 68 downwardly relative to housing 58 while annular piston 86 reacts the fluid pressure. Seal plate 68 is then seated on shoulder 14 with indicator pins 82 being in a down position which can be easily observed. Tubular stab members 70, 72 are stabbed and sealed within bores 13 and 15 by elastomeric seal rings 74. Locking segments 76 remain in an unlocked position and handle 92 remains in a projected relation indicating that annular piston 86 has not moved into locked relation with locking segments 76.

From the position of FIG. 13 which shows the indicator rods 82 in a down position and with sealing plate 68 seated on shoulder 14, fluid is applied from coupler 98 through line 94 to move annular piston 86 downwardly to cam locking segments 76 outwardly within locking groove 16 in hub 10. In this position, indicator handle 92 is moved downwardly by indicator rods 90 to the position shown in FIG. 1 which indicates that tree cap 28 is in the installed position. In the installed position, the hot stab couplers 98 and 112 may be removed by the ROV by gripping of handles 99 and 116 for pulling the couplers 98 and 112 from receptacles 100, 114 on body 30. Prior to removal of the fluid pressure couplers 98 and 112, the high pressure coupler 112 may be utilized to test, vent or inject chemicals for the production and annulus bores 13 and 15. A three-way valve on a ROV manifold is controlled for performing the test. After the tests have been completed, the fluid lines are vented and couplers 98 and 112 are removed. Dummy couplers are then inserted within receptacles 100, 114 to prevent the entrance of debris and the like in the receptacles. The fluid couplers 98 and 112 are positioned within suitable parking receptacles on the tree frame for future use, such as retrieval or removal of tree cap 28.

Retrieval of Tree Cap

For removal or retrieval of tree cap 28 from the installed position shown in FIG. 1, the dummy stab members are removed from the low pressure and high pressure receptacles 100 and 114. Then, the low pressure and high pressure fluid couplers 98 and 112 are removed from their parking receptacle openings and are then pushed downwardly by manipulator arms of the ROV into receptacles 110 and 114. Fluid is then applied through coupler 98 and fluid passage 96 to lift piston 86 upwardly from engagement with locking segments 76. Indicator rods 90 and handle 92 move upwardly to indicate that latch members 76 have been unlatched. Locking segments 76 are now free to retract. Next, high pressure fluid is applied through coupler 112 and line 122 to needle valve 124, and thence through fluid lines 108 and 110 to move seal plate 68 upwardly. Locking segments 76 are cammed inwardly to an unlatched position, and seal plate 68 moves upwardly until tubular seal members 70 and 72 are out of sealing relation with production bore 13 and annulus bore 15. Indicator rods 82 may be visually observed to indicate the position of seal plate 68 and associated tubular seal members 70 and 72.

Latch pins 36 are in engaged position with annular groove 12. For removal of latch pins 36, handles 52 are rotated by the manipulator arms of the ROV to pull flexible cables 40 upwardly with enlarged ends 42 contacting shoulders 46 thereby to retract pins 36 and remove pins 36 from groove 12. Upon removal of latch pins 36, handle 92 is gripped by a ROV manipulator arm and lifted upwardly for removal of tree cap 28 from hub 10.

From the above, an ROV deployable tree cap 28 has been provided including a plastic body 30 on which all of the operating elements and members of the tree cap 28 are mounted. Handles 52,92,99, and 116 are easily accessible from upper end 29 of cap body 30 by manipulator arms of the ROV. Mounting bases 35 on body 30 provide for mounting and ROV accessibility of the various control elements utilized by the ROV. The seal plate assembly 64, locking segments 76, and annular piston 86 are formed of metal such as Inconel 718. However, the remaining non-pressure bearing elements and the outer housing may be formed of a lightweight plastic or composite material, preferably a high density, high molecular weight plastic material, such as polypropylene, for example. As a result, a tree cap 28 having a submerged weight less than about 100 pounds is provided. Since an ROV is capable of physically handling the tree cap 28, the tree cap may be removed and replaced subsea without having to make an extra trip with drill pipe.

According to another feature of the invention, a tree cap 28 may be initially stored on the tree frame. The tree cap may be removed from its storage position on the tree frame and installed on the tree hub 10, with the ROV. All such operations are accomplished rapidly with the ROV without an additional trip to the surface. Alternatively, a spare tree cap may be stored on the tree frame. If another tree cap is damaged, the damaged tree cap is withdrawn from the tree hub, stored on the sea floor or on the tree frame, and the spare tree cap is installed on the tree hub 10, with the ROV.

The present invention and the best modes of practicing it have been described. It is to be understood that the foregoing descriptions are illustrative only and that other means and techniques can be employed without departing from the full scope of the invention as described in the appended claims.

What is claimed is:

1. A method of forming a ROV deployable tree cap constructed and arranged for installation on a production hub of a subsea tree; said method comprising the steps of:

forming a tree cap body from a lightweight non-metallic material to define a pair of generally parallel sides connected by upper and lower ends;

positioning a metallic sealing member movable relative to said non-metallic body on the lower end of said non-metallic body;

providing fluid control means on said tree cap body to effect movement of said sealing member relative to said body; and moving said metallic sealing member downwardly in response to said fluid control means relative to said body into a sealing position with the production bore of said hub.

2. The method as set forth in claim 1 further including the steps of:

providing releasable locking members for said sealing member in the sealing position of said sealing member;

providing additional fluid control means on said tree cap body for locking of said locking members; and moving said locking members in response to said additional fluid control means into locked position after said sealing member is moved into sealing position with said production bore.

3. The method as set forth in claim 1 further including the steps of:

forming said metallic sealing member of a seal plate for fitting on the upper end of said hub and a piston extending upwardly from said seal plate; and applying fluid to said piston from said first mentioned fluid control means to move said seal plate into sealing position with said production bore of said hub.

4. The method as set forth in claim 1 further including the steps of:

providing a pair of spring urged latch pins on said tree cap body for engaging an outer peripheral groove on said production hub in a latched relation upon downward movement of said tree cap onto said hub;

providing actuating means for said pins on the upper end of said body for unlatching of said pins from said groove; and actuating said actuating means from an ROV to unlatch said pins from said groove for removal of said tree cap from said production hub.

5. The method as set forth in claim 4 including the steps of:

providing an ROV accessible handle on said upper end of said tree cap body; and operating said ROV accessible handle for unlatching of said pins from said production hub.

6. The method as set forth in claim 2 wherein said additional fluid control means on said body for locking of said locking members includes a fluid operated piston; and further including the step of:

actuating said fluid operated piston from said additional fluid control means for movement of said piston into a locking relation with said locking members.

7. The method as set forth in claim 6 further including the step of:

actuating said additional fluid control means for movement of said piston out of locking relation with said locking members.

8. The method as set forth in claim 1 including the steps of:

providing a plurality of mounting positions along the upper end of said tree cap body; and mounting a plurality of ROV accessible control elements on said mounting positions for controlling a releasable connection of the tree cap on the hub, the control elements having handles positioned for engagement by manipulator arms of the ROV for permitting installation of the tree cap on the subsea tree and retrieval of the tree cap from the subsea tree.

9. A method for installing a subsea Xmas tree cap on a subsea Xmas tree above the mudline; the subsea Xmas tree having a projecting upper hub to receive the tree cap including a production bore and an annulus bore, said upper hub having an outer peripheral surface and an inner peripheral surface; the method comprising the steps of:

providing the tree cap with an outer latch means for latching into the outer peripheral surface of said upper hub, a fluid operated inner latch means for latching onto the inner peripheral surface of said upper hub, and a seal plate for sealing the production bore and the annulus bore;

lowering the tree cap onto said hub, latching said cap with said outer latch means onto the outer surface of said hub;

moving said seal plate downwardly relative to said tree cap against said projecting upper hub of said Xmas tree to provide a sealing relation with said production bore and annulus bore; and then latching said seal plate with said fluid operated inner latching means to the inner peripheral surface of said upper hub.

10. The method as set forth in claim 9 including the steps of:

providing fluid pressure means for moving said seal plate downwardly into sealing relation with said upper hub; and providing fluid pressure to said fluid operated inner latch means after said seal plate is in sealed relation to urge said fluid operated inner latch means into releasable locking position with said inner peripheral surface of said upper hub.

11. A lightweight ROV deployable tree cap for a subsea tree having a projecting production hub and an outer funnel guide supported on the hub with alignment means on the guide for the cap said cap comprising:

a lightweight elongate non-metallic cap body extending across the funnel guide and supported thereon in an aligned position with the subjacent hub on the tree;

a seal plate member mounted on said cap body for relative movement and positioned over a production bore of the hub; and fluid pressure means for forcing said seal plate member downwardly relative to said cap body into a sealed landed position with the production bore of said hub.

12. The lightweight ROV deployable tree cap as set forth in claim 11, wherein said fluid pressure means includes a piston operatively connected to said seal plate member for forcing said seal plate member downwardly into sealed position with the production bore when actuated.

13. The lightweight ROV deployable tree cap as set forth in claim 11, wherein said seal plate member has a downwardly extending tubular member for fitting within said production bore in sealing relation upon landing of said seal plate member on the upper end of said hub.

14. A lightweight ROV deployable tree cap for a subsea tree having an upper production hub including a production bore, and an annulus bore; said tree cap comprising:

a lightweight non-metallic body having a plurality of openings and bores therein for mounting of operating elements of said tree cap thereon for latching onto said hub and for sealing said production and annulus bores; said operating elements including latch means for initially latching externally onto said hub prior to sealing of said production and annulus bore; and hydraulically actuated sealing means movable relative to said body for sealing said production and annulus bores after said latch means has latched onto said hub.

15. A lightweight ROV deployable tree cap as set forth in claim 14, wherein said sealing means includes a sealing plate for landing on said hub and a hydraulically actuated piston for forcing said sealing plate into landed position on said hub for sealing against said hub.

16. A lightweight ROV deployable tree cap as set forth in claim 15, wherein said sealing plate has a pair of downwardly projecting tubular sealing members for fitting within said production and annulus bores in sealing relation thereto upon landing of said sealing plate on said hub.

17. A lightweight deployable tree cap as set forth in claim 14, wherein an outer housing is mounted on said cap body in fixed relation and receives said hydraulically actuated sealing means therein, said sealing means including a seal plate having downwardly extending tubular seal members for fitting within said production and annulus bores in sealing relation, said hub having a landing shoulder for contacting said sealing plate in landed relation upon actuation of said hydraulically actuated sealing means and downward movement of said sealing plate relative to said outer housing.

18. A lightweight ROV deployable tree cap for a subsea tree having a hub with a production bore therein; said ROV deployable tree cap comprising:

a lightweight non-metallic body having a plurality of predetermined mounting positions for mounting a plurality of operating assemblies thereon for coupling onto said hub and sealing against said production bore; said operating assemblies including:

coupling means for coupling said tree cap onto said hub; and hydraulically operated sealing means for sealing said production bore after coupling of said coupling means to said hub.

19. A lightweight ROV deployable tree cap as set forth in claim 18, wherein said non-metallic body has a pair of generally parallel opposed sides and an upper end extending between said opposed sides; and a handle mounted on said upper end engageable by an ROV for maneuver of said tree cap by the ROV including lifting and lowering of the tree cap.

20. A lightweight ROV deployable tree cap as set forth in claim 18, wherein hydraulic fluid actuating means are operatively connected to said hydraulically operated sealing means to force said sealing means downwardly into sealing relation with said production bore; and a hydraulic fluid source on said ROV is operatively connected to said fluid actuating means for actuation of said sealing means.

21. A lightweight ROV deployable tree cap as set forth in claim 20, wherein a hydraulic fluid coupler is removably mounted on said non-metallic body for coupling said fluid actuating means to said hydraulic fluid source.

22. A lightweight ROV deployable tree cap as set forth in claim 21, wherein said hydraulic fluid coupler is mounted on an upper end of said non-metallic body and a handle extends therefrom engageable by a ROV manipulator arm for installation of said coupler for the supply of hydraulic fluid to said hydraulic fluid actuating means.

23. A lightweight ROV deployable tree cap as set forth in claim 21, wherein a receptacle is mounted on the upper end of said non-metallic body for said hydraulic fluid coupler and has fluid lines extending therefrom, and said hydraulic fluid coupler has a handle thereon engageable by said ROV for installation of said fluid coupler within said receptacle.

24. A lightweight ROV deployable tree cap as set forth in claim 18, wherein said hub has an outer annular groove thereabout, said coupling means for coupling said tree cap onto said hub includes a plurality of latch pins engageable in a projected position with said groove upon lowering of said tree cap onto said hub for initial latching of said tree cap onto said hub; and a handle is mounted on said non-metallic body for engagement by the ROV for movement of said latch pins to retracted position removed from said groove to permit release of said tree cap from said hub.

25. A lightweight ROV deployable tree cap as set forth in claim 18, wherein said hub has an inner annular groove about its inner peripheral surface and an annular shoulder adjacent said groove; said hydraulically operated sealing means for sealing said production bore including a sealing plate for landing on said shoulder in a sealed relation to said production bore; and said coupling means includes locking segments for fitting within said inner annular groove when said sealing plate is landed on said shoulder, and hydraulic fluid means for forcing said sealing plate downward into a landed position on said shoulder and for forcing said locking segments into locking engagement with said inner annular groove after landing of said sealing plate.

26. A lightweight ROV deployable tree cap as set forth in claim 25, wherein said hydraulic fluid means includes a first fluid actuated piston for forcing said sealing plate downwardly and a second fluid actuated piston for forcing said locking segments into locking engagement.

27. A lightweight ROV deployable tree cap as set forth in claim 26, wherein a position indicator member is operatively connected to said sealing plate to indicate visually when said sealing plate is in a landed position.

28. A lightweight ROV deployable tree cap as set forth in claim 16, wherein a position indicator member is operatively connected to said locking segments to indicate visually when said locking segments are in a locked position.

* * * * *